US008540529B2

(12) United States Patent
Warren et al.

(10) Patent No.: US 8,540,529 B2
(45) Date of Patent: Sep. 24, 2013

(54) SHIELDED USB CONNECTOR MODULE WITH MOLDED HOOD AND LED LIGHT PIPE

(75) Inventors: Robert W. Warren, Newport Beach, CA (US); Nic Rossi, Radio (HK)

(73) Assignee: Conexant Systems, Inc., Irvine, CA (US)

( * ) Notice: Subject to any disclaimer, the term of this patent is extended or adjusted under 35 U.S.C. 154(b) by 93 days.

(21) Appl. No.: 13/196,379

(22) Filed: Aug. 2, 2011

(65) Prior Publication Data

US 2013/0034990 A1 Feb. 7, 2013

(51) Int. Cl.
*H01R 3/00* (2006.01)

(52) U.S. Cl.
USPC ..... 439/490; 362/555

(58) Field of Classification Search
USPC ..... 439/76.1, 490, 607.01; 340/687; 362/555
See application file for complete search history.

(56) References Cited

U.S. PATENT DOCUMENTS

| | | | | |
|---|---|---|---|---|
| 6,626,703 | B2 * | 9/2003 | Hsin | 439/638 |
| 6,743,044 | B2 * | 6/2004 | Musolf et al. | 439/490 |
| 6,979,223 | B2 * | 12/2005 | Chen | 439/490 |
| 7,297,024 | B2 * | 11/2007 | Ni et al. | 439/607.23 |
| 7,470,148 | B1 * | 12/2008 | Su et al. | 439/607.01 |
| 7,976,335 | B2 * | 7/2011 | Weber et al. | 439/487 |
| 8,124,496 | B2 * | 2/2012 | Su et al. | 438/449 |
| 8,206,019 | B2 * | 6/2012 | Chen et al. | 362/581 |
| 2012/0149214 | A1 * | 6/2012 | Zhang et al. | 439/55 |

* cited by examiner

*Primary Examiner* — Thanh Tam Le
(74) *Attorney, Agent, or Firm* — Farjami & Farjami LLP

(57) ABSTRACT

There is provided a system and method for a shielded connector module with a molded hood and an LED light pipe. There is provided a shielded connector module comprising a system-in-package (SiP) device having a surface mounted light emitting diode (LED), a metallic shield surrounding the SiP device, a molded hood surrounding the metallic shield, and an LED light pipe in a proximity with the surface mounted LED, the LED light pipe being directed through the metallic shield and the molded hood. By designing the LED light pipe with a concave surface for surrounding the surface mounted LED and by using various techniques to reduce a gap between the LED and the light pipe, light capture and transmission may be optimized for easily viewable high intensity light. A fresnel lens may be optionally attached to the light pipe for wider viewing angles.

20 Claims, 3 Drawing Sheets

SHIELDED USB CONNECTOR MODULE WITH MOLDED HOOD AND LED LIGHT PIPE

BACKGROUND OF THE INVENTION

1. Field of the Invention

The present invention relates generally to cable connector assemblies. More particularly, the present invention relates to cable connector assemblies with integrated light emitting diodes (LEDs).

2. Background Art

System-in-package (SiP) devices are often desirable in many circuit applications due to increased functionality, high performance, and compact form factor. In particular, because of their compact size, SiP devices may be directly integrated into connector modules, such as Universal Serial Bus (USB) connectors, to provide additional functionality while retaining the size footprint of a standard cable. Maintaining a slim connector profile may be particularly important for compatibility with tightly spaced connection ports, such as USB ports that may be grouped closely together on a laptop or another mobile device.

One example of providing additional functionality is embedding light emitting diodes (LEDs) as status indicators. For example, LEDs may indicate power status, data transfer status, error status, or any other condition, allowing users to readily troubleshoot potential issues and to confirm proper cable operation. LEDs may also emit visible or non-visible light for other uses besides status indicators, for example to send infrared remote control signals, to transfer optical data, to detect motion or position, or to detect the presence of smoke or other hazardous conditions.

However, it is difficult to obtain sufficient visibility of the LEDs outside of the connector module. One option is to use a transparent or semitransparent plastic hood for the connector module to permit light transmission. However, given the relatively deep embedding of the LEDs within the connector module, the poor optical transmission properties of the plastic housing, and the presence of metallic shielding for grounding and protection, the LEDs may be difficult to identify due to low light intensity and restricted viewing angles. Additionally, the transparent plastic hood may expose the inner wiring and construction of the module, which may be aesthetically undesirable.

Accordingly, there is a need to overcome the drawbacks and deficiencies in the art by providing a way to integrate LEDs of a SiP device into a connector module while providing high outside visibility of the LEDs.

SUMMARY OF THE INVENTION

There are provided systems and methods for a shielded connector module with a molded hood and an LED light pipe, substantially as shown in and/or described in connection with at least one of the figures, as set forth more completely in the claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

The present application is directed to a system and method for a shielded connector module with a molded hood and an LED light pipe. The following description contains specific information pertaining to the implementation of the present invention. One skilled in the art will recognize that the present invention may be implemented in a manner different from that specifically discussed in the present application. Moreover, some of the specific details of the invention are not discussed in order not to obscure the invention. The specific details not described in the present application are within the knowledge of a person of ordinary skill in the art. The drawings in the present application and their accompanying detailed description are directed to merely exemplary embodiments of the invention. To maintain brevity, other embodiments of the invention, which use the principles of the present invention, are not specifically described in the present application and are not specifically illustrated by the present drawings. Additionally, for reasons of clarity, the drawings may not be to scale.

Figure 1A:
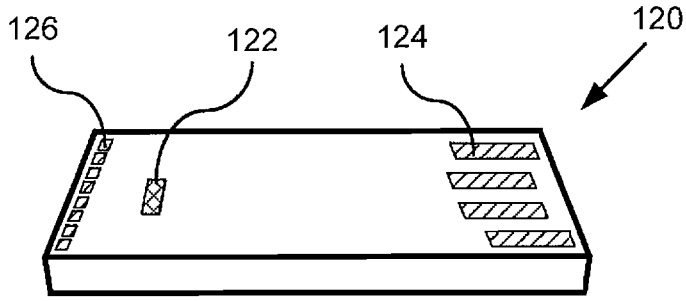
FIG. 1A presents a perspective view of a system-in-package (SiP) device, according to an embodiment of the present invention.

FIG. 1A presents a perspective view of a system-in-package (SiP) device, according to an embodiment of the present invention. SiP device 120 includes surface mounted LED 122, connector contacts 124, and cable contacts 126. SiP device 120 may also include other components that are not illustrated in FIG. 1A.

SiP device 120 may, for example, provide status notifications for a USB device, such as a USB headset. Thus, surface mounted LED 122 may change intensity depending on power status, connection status, volume level, or other parameters, and may comprise any color such as red, green, blue, or white. Additionally, while only a single surface mounted LED 122 is shown, alternative embodiments may utilize multiple LEDs of different colors to provide additional status information. As previously discussed, surface mounted LED 122 may also provide other functions besides status notifications. For example, in some embodiments, surface mounted LED 122 may function to send infrared remote control signals, to transfer optical data, to detect motion or position, or to detect the presence of smoke or other hazardous conditions.

As shown in FIG. 1A, the connector contacts 124 may comprise the four-conductor USB Standard Type-A connector. However, in alternative embodiments, SiP device 120 may be configured for another connector standard. The cable contacts 126 may be connected to cable wires that are coupled to the USB device. While eight conductors are shown for cable contacts 126 in FIG. 1A, alternative embodiments may use any number of cable contacts 126, depending on the required number of conducting cable wires. Furthermore, while not illustrated in FIG. 1A, additional hardware may be integrated into SiP device 120 such as, for example, a demultiplexer, an encoder chip, an analog to digital converter, a digital signal processor, a transceiver chip, a microcontroller, and other devices. SiP device 120 may be assembled using conventional fabrication methods and may comprise an overmolded laminate PCB.

Figure 1B:
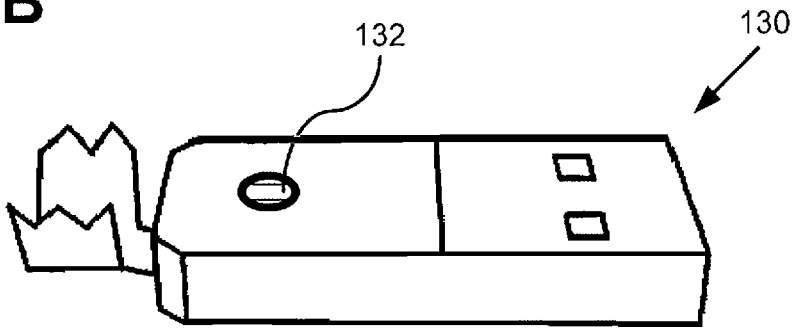
FIG. 1B presents a perspective view of a metallic shield, according to an embodiment of the present invention.

Moving to FIG. 1B, FIG. 1B presents a perspective view of a metallic shield, according to an embodiment of the present invention. Metallic shield 130 includes a hole 132 to allow an LED light pipe to pass through, as discussed below. Metallic shield 130 may surround and protect SiP device 120 and may also be connected to system ground.

Figure 1C:
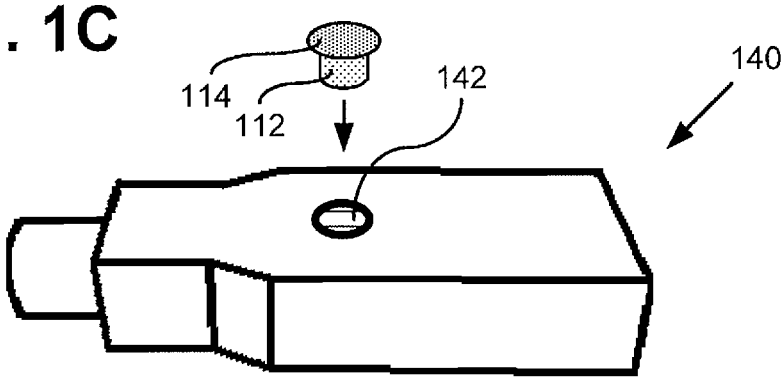
FIG. 1C presents a perspective view of a molded hood with an opening for an LED light pipe, according to an embodiment of the present invention.

Next, FIG. 1C presents a perspective view of a molded hood with an opening for an LED light pipe, according to an embodiment of the present invention. Molded hood 140 includes a hole 142 to allow LED light pipe 112 to pass through. LED light pipe 112 may optionally include a fresnel lens 114 attached to a surface thereof exposed to the outside of molded hood 140. LED light pipe 112 may comprise optical grade materials with high optical transmission properties, such as optical grade acrylic. LED light pipe 112 may be formed into any desired shape, such as a cylindrical or rectangular block shape. Additionally, LED light pipe 112 and molded hood 140 may both be molded using a dual-shot molding operation. Molded hood 140 may comprise opaque materials, such as an opaque plastic, to hide the internal circuitry and wiring of the connector module.

Figure 1D:
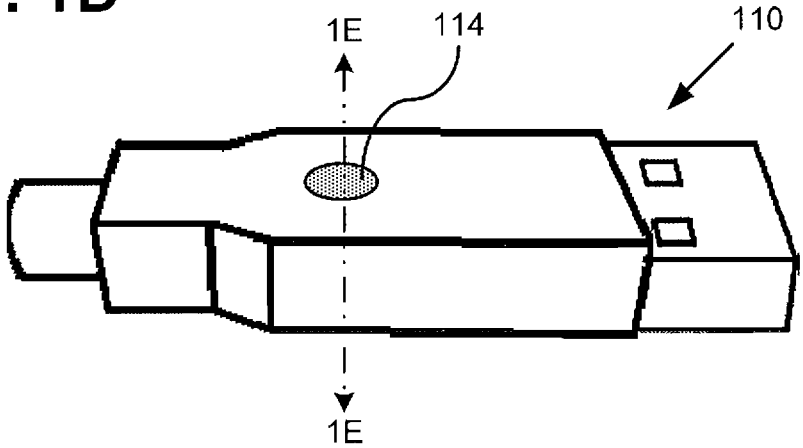
FIG. 1D presents a perspective view of an assembled connector module, according to an embodiment of the present invention.

Turning to FIG. 1D, FIG. 1D presents a perspective view of an assembled connector module, according to an embodiment of the present invention. By surrounding the SiP device 120 with metallic shield 130 and molded hood 140, and by inserting the LED light pipe 112 such that only the fresnel lens 114 is visible outside of the molded hood 140, a completed connector module 110 is provided. Although omitted from FIG. 1D, the connector module 110 may then connect to a device, such as a headset, by a multi-conductor cable.

Figure 1E:
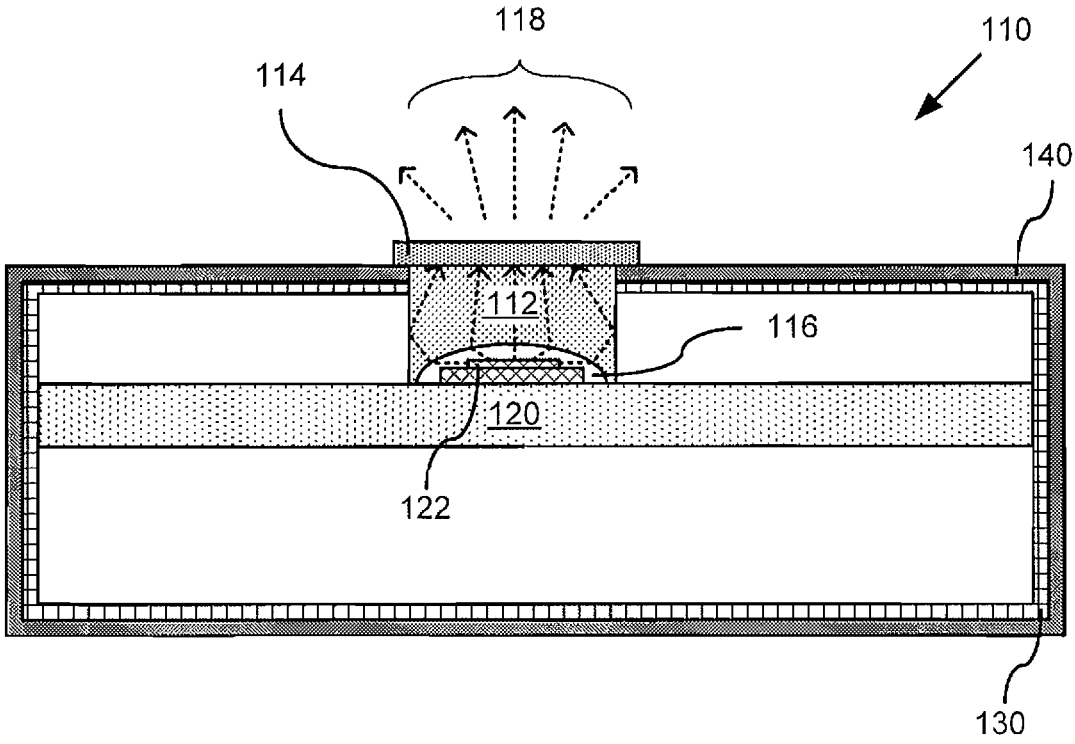
FIG. 1E presents a cross sectional view of an assembled connector module, according to an embodiment of the present invention.

FIG. 1E presents a cross sectional view of an assembled connector module, according to an embodiment of the present invention. The cross sectional view of FIG. 1E may correspond to a cross section indicated by line 1E in FIG. 1D. As shown in FIG. 1E, the cross sectional view of connector module 110 shows SiP device 120 being surrounded by metallic shield 130 and molded hood 140. The surface mounted LED 122 on top of SiP device 120 is surrounded by a concave surface of LED light pipe 112, which may also include standoff legs for proper height positioning. As previously discussed, both the LED light pipe 112 and the molded hood 140 may be formed using a dual-shot molding operation, allowing manufacture of connector module 110 to tight physical tolerances. Accordingly, the LED light pipe 112 may be placed in close proximity, but not in direct contact, with the surface mounted LED 122. For example, the gap 116 defining a proximity from the concave surface of LED light pipe 112 to the surface mounted LED 122 may be no greater than 0.05 inches or 1.27 mm.

Additionally, the LED light pipe 112 may be secured in place using one or more features such as a locking shoulder and/or an annular ring. Accordingly, the use of conventional retaining mechanisms, such as lock washers, grommets, spring clips, nuts, and other hardware may be avoided. Advantageously, this allows connector module 110 to retain a compact form factor and low assembly cost.

By minimizing the size of gap 116 as described above, light transmission from surface mounted LED 122 is optimized, capturing approximately 92% of the emitted light. Furthermore, by attaching an optically translucent epoxy or a similar material to the concave surface of LED light pipe 112, the gap 116 may be filled with the epoxy rather than air, increasing the light capture up to 100% if the gap 116 is completely eliminated. Additionally, fresnel lens 114 may optionally help to disperse light rays 118, providing a wide viewing angle of up to 180 degrees for easy user observation from any position. While fresnel lens 114 is shown as protruding from the top surface of connector module 110, alternative embodiments may place fresnel lens 114 flush with the top surface of connector module 110. Additionally, as previously discussed, since multiple surface mount LEDs may be mounted on SiP device 120, multiple LED light pipes may also be correspondingly provided, in a manner similar to LED light pipe 112.

Figure 2:
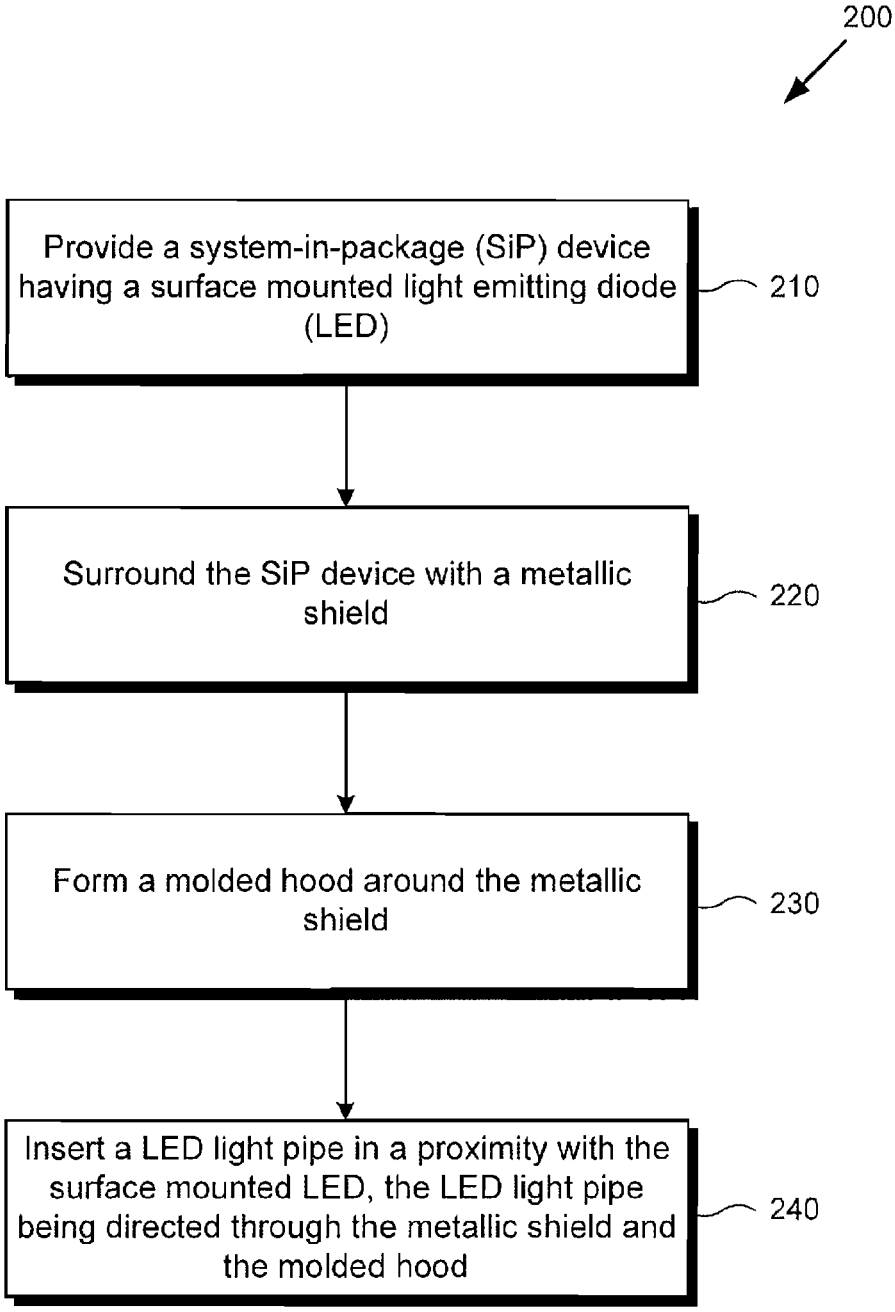
FIG. 2 shows a flowchart describing the steps, according to one embodiment of the present invention, by which a shielded connector module with a molded hood and an LED light pipe may be provided.

FIG. 2 shows a flowchart describing the steps, according to one embodiment of the present invention, by which a shielded connector module with a molded hood and an LED light pipe may be provided. Certain details and features have been left out of flowchart 200 that are apparent to a person of ordinary skill in the art. For example, a step may comprise one or more substeps or may involve specialized equipment or materials, as known in the art. While steps 210 through 240 indicated in flowchart 200 are sufficient to describe one embodiment of the present invention, other embodiments of the invention may utilize steps different from those shown in flowchart 200.

Referring to step 210 of flowchart 200 in FIG. 2 and SiP device 120 of FIG. 1A, step 210 of flowchart 200 comprises providing a SiP device 120 having a surface mounted LED 122. As shown in FIG. 1A, the connector contacts 124 of SiP device 120 may be configured as a USB Standard Type A Connector or another connector standard. The SiP device 120 may be fabricated using methods known in the art and may comprise an overmolded laminate PCB.

Referring to step 220 of flowchart 200 in FIG. 2, SiP device 120 of FIG. 1A, and metallic shield 130 of FIG. 1B, step 220 of flowchart 200 comprises surrounding SiP device 120 with metallic shield 130. The metallic shield 130 is aligned with SiP device 120 such that the hole 132 is positioned above the surface mounted LED 122. As previously discussed, the metallic shield 130 may also be coupled to system ground.

Referring to step 230 of flowchart 200 in FIG. 2, metallic shield 130 of FIG. 1B, and molded hood 140 of FIG. 1C, step 230 of flowchart 200 comprises forming a molded hood 140 around metallic shield 130. For example, molded hood 140 may be pre-formed and placed around metallic shield 130, or molded hood 140 may be formed directly around metallic shield 130. The metallic shield 130 is aligned with molded hood 140 such that the holes 132 and 142 are in alignment. Further, as previously discussed, the molded hood 140 and the LED light pipe 112 may have been previously molded using a dual-shot molding operation, and the molded hood 140 may comprise opaque materials such as plastic.

Referring to step 240 of flowchart 200 in FIG. 2, SiP device 120 of FIG. 1A, metallic shield 130 of FIG. 1B, LED light pipe 112 and molded hood 140 of FIG. 1C, and connector module 110 of FIG. 1D, step 240 of flowchart 200 comprises inserting LED light pipe 112 in a proximity with surface mounted LED 122, LED light pipe 112 being directed through metallic shield 130 and molded hood 140. As shown by the cross sectional area of connector module 110 as shown in FIG. 1E, the LED light pipe 112 is directed through hole 132 of metallic shield 130 and hole 142 of molded hood 140, and is placed in close proximity to surface mounted LED 122. LED light pipe 112 may be secured into place using one or more features such as locking shoulders or annular rings. As previously discussed, by minimizing the distance of gap 116 between the concave surface of LED light pipe 112 and surface mounted LED 112, light capture and transmission of light rays 118 may be optimized. Optically translucent epoxy may optionally fill the air within gap 116 to increase light capture. The optional addition of fresnel lens 114 may also increase the viewing angle of light rays 118.

Thus, a method for providing a shielded connector module with a molded hood and an LED light pipe has been disclosed. The disclosed connector module may provide status indicator lights with high intensity and wide viewing angles, allowing users to easily ascertain device status and/or to provide other features such as data communication and environmental monitoring without increasing the size of the connector module. The quality of the emitted light may be superior to conventional designs with transparent or semi-transparent hoods, and the use of an opaque molded hood may advantageously hide internal construction and wiring for an attractive visual appearance.

From the above description of the invention it is manifest that various techniques can be used for implementing the concepts of the present invention without departing from its scope. Moreover, while the invention has been described with specific reference to certain embodiments, a person of ordinary skills in the art would recognize that changes can be made in form and detail without departing from the spirit and the scope of the invention. As such, the described embodiments are to be considered in all respects as illustrative and not restrictive. It should also be understood that the invention is not limited to the particular embodiments described herein, but is capable of many rearrangements, modifications, and substitutions without departing from the scope of the invention.

What is claimed is:

1. A shielded connector module comprising:

a system-in-package (SIP) device having a surface mounted light emitting diode (LED) on a top surface of the SiP device;

a metallic shield surrounding the SiP device and having a first hole above the top surface of the SiP device;

a molded hood surrounding the metallic shield and having a second hole above the first hole;

an LED light pipe in a proximity with the surface mounted LED, the LED light pipe being directed through the first hole in the metallic shield and the second hole in the molded hood.

2. The shielded connector module of claim 1, wherein the SiP device includes contacts for a Universal Serial Bus (USB) connection.

3. The shielded connector module of claim 1, wherein the molded hood comprises opaque materials.

4. The shielded connector module of claim 1, wherein the LED light pipe includes a fresnel lens on a surface thereof that is exposed outside of the molded hood.

5. The shielded connector module of claim 1, wherein the LED light pipe comprises optical grade acrylic materials.

6. The shielded connector module of claim 1, wherein the LED light pipe is secured in place by a locking shoulder.

7. The shielded connector module of claim 1, wherein the LED light pipe is secured in place by an annular ring.

8. The shielded connector module of claim 1, wherein the LED light pipe includes a concave surface surrounding the surface mounted LED.

9. The shielded connector module of claim 8, wherein the proximity of the LED light pipe to the surface mounted LED is no greater than 0.05 inches or 1.27 mm.

10. The shielded connector module of claim 8, wherein a gap between the concave surface and the surface mounted LED is filled with an optically translucent epoxy.

11. A method of creating a shielded connector module, the method comprising:

providing a system-in-package (SIP) device having a surface mounted light emitting diode (LED) on a top surface of the SiP device;

surrounding the SiP device with a metallic shield having a first hole above the top surface of the SiP device;

forming a molded hood around the metallic shield having a second hole above the first hole;

inserting an LED light pipe in a proximity with the surface mounted LED, the LED light pipe being directed through the first hole in the metallic shield and the second hole in the molded hood.

12. The method of claim 11, further comprising, prior to the forming of the molded hood:

molding the molded hood and the LED light pipe in a dual-shot molding operation.

13. The method of claim 11, wherein the SiP device includes contacts for a Universal Serial Bus (USB) connection.

14. The method of claim 11, wherein the molded hood comprises opaque materials.

15. The method of claim 11, wherein the LED light pipe includes a fresnel lens on a surface thereof that is exposed outside of the molded hood.

16. The method of claim 11, wherein the inserting of the LED light pipe is secured in place by a locking shoulder.

17. The method of claim 11, wherein the inserting of the LED light pipe is secured in place by an annular ring.

18. The method of claim 11, wherein the LED light pipe includes a concave surface surrounding the surface mounted LED.

19. The method of claim 18, wherein the proximity of the LED light pipe to the surface mounted LED is no greater than 0.05 inches or 1.27 mm.

20. The method of claim 18, wherein a gap between the concave surface and the surface mounted LED is filled with an optically translucent epoxy.

* * * * *